US011587509B2

(12) United States Patent
Ryu

(10) Patent No.: US 11,587,509 B2
(45) Date of Patent: Feb. 21, 2023

(54) DISPLAY DEVICE HAVING A PRE-DRIVING VOLTAGE FOR EACH SUBPIXEL

(71) Applicant: LG Display Co., Ltd., Seoul (KR)

(72) Inventor: Sungbin Ryu, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/522,713

(22) Filed: Nov. 9, 2021

(65) Prior Publication Data

US 2022/0148510 A1 May 12, 2022

(30) Foreign Application Priority Data

Nov. 9, 2020 (KR) ..... 10-2020-0148505

(51) Int. Cl.
*G09G 3/3258* (2016.01)
*G09G 3/3266* (2016.01)
*G09G 3/3275* (2016.01)

(52) U.S. Cl.
CPC ..... *G09G 3/3258* (2013.01); *G09G 3/3266* (2013.01); *G09G 3/3275* (2013.01); *G09G 2310/0294* (2013.01); *G09G 2310/08* (2013.01); *G09G 2320/0233* (2013.01)

(58) Field of Classification Search
CPC ..... G09G 3/3258
USPC ..... 345/76
See application file for complete search history.

(56) References Cited

U.S. PATENT DOCUMENTS

2014/0152633 A1* 6/2014 Park ..... G09G 3/3291 345/207
2016/0351121 A1* 12/2016 Kim ..... G09G 3/3233

FOREIGN PATENT DOCUMENTS

KR 10-2019-0072200 A 6/2019

* cited by examiner

*Primary Examiner* — Long D Pham
(74) *Attorney, Agent, or Firm* — Seed Intellectual Property Law Group LLP

(57) ABSTRACT

A display device compensates a threshold voltage Vth of a driving transistor according to a source follower internal compensation method. The threshold voltage Vth of the driving transistor is sampled in advance before one horizontal period H, so that a sufficient time for sampling the threshold voltage Vth of the driving transistor can be obtained even in a high-speed or high-resolution display device. Furthermore, the compensation rate of the internal compensation circuit is improved to reduce luminance deviation between the pixels.

22 Claims, 12 Drawing Sheets

(a)

(b)

DISPLAY DEVICE HAVING A PRE-DRIVING VOLTAGE FOR EACH SUBPIXEL

CROSS REFERENCE TO RELATED APPLICATION

This application claims the benefit of Korean Patent Application No. 10-2020-0148505 filed on Nov. 9, 2020, the entire contents of which is incorporated herein by reference for all purposes as if fully set forth herein.

BACKGROUND

Technical Field

The present disclosure relates to a display device which compensates a threshold voltage Vth of a driving transistor according to a source follower internal compensation method.

Description of the Related Art

An active matrix type organic light emitting diode display includes an organic light emitting diode (OLED) which emits light by itself, and has an advantage of having a rapid response speed, a high light emission efficiency, a high luminance, and a wide viewing angle.

The organic light emitting diode, which is a self-light emitting device, includes an anode electrode, a cathode electrode, and an organic compound layer (HIL, HTL, EML, ETL, and EIL) formed therebetween. The organic compound layer includes a hole injection layer (HIL), a hole transport layer (HTL), an emission layer (EML), an electron transport layer (ETL) and an electron injection layer (EIL). When a driving voltage is applied to the anode and cathode electrodes, holes passing through the hole transport layer (HTL) and electrons passing through the electron transport layer (ETL) move to the emission layer (EML) to form excitons, and as a result, the emission layer (EML) generates visible light.

An organic light emitting display device includes a driving thin film transistor (TFT) to control a driving current flowing through the organic light emitting diode. It is preferable that the electrical characteristics of the thin film transistor such as a threshold voltage Vth and mobility are designed the same in all the pixels. In practice, however, the electrical characteristics of the thin film transistor are non-uniform for each pixel due to process conditions and driving environment. For this reason, the driving current according to the same data voltage changes for each pixel, and as a result, a luminance deviation occurs between the pixels. In order to solve this problem, known is an image quality compensation technique for reducing luminance non-uniformity by sensing characteristic parameters (threshold voltage Vth, mobility) of the thin film transistor from each pixel and by appropriately correcting input data in accordance with the sensing result.

Among the image quality compensation techniques, an internal compensation method controls a pixel structure and a drive timing to exclude the electrical characteristics of the thin film transistor while the organic light emitting diode emits light. The internal compensation method basically performs a sampling operation of saturating the thin film transistor to a certain level by increasing a gate voltage of the thin film transistor in a source follower manner. In the internal compensation method, sufficient time is required to saturate the gate voltage of the thin film transistor to a desired level.

However, in the trend of high-resolution and high-speed driving of the organic light emitting display device, the difference in drive characteristics of the pixel cannot be sufficiently compensated by a conventional compensation method. For example, as a resolution increases and a driving frequency increases, one horizontal period 1H during which data is written to the pixels in one line in a display panel is reduced. One horizontal period 1H is a time in which data is written to pixels arranged in one horizontal line on the screen.

A driving circuit of the organic light emitting display device samples the threshold voltage Vth of the thin film transistor within one horizontal period 1H, compensates a data voltage by means of the threshold voltage Vth, and writes the data to the pixels. When the one horizontal period 1H is reduced, a threshold voltage Vth sampling period of the thin film transistor is reduced. If a time required for sampling the threshold voltage Vth of the thin film transistor is insufficient, the threshold voltage Vth of the thin film transistor is incorrectly sensed, so that the difference in drive characteristics between the pixels may occur. Even though data of the same gradation is written to all the pixels, the difference in drive characteristics between the pixels causes a difference in luminance, so that spots may be seen on the screen.

BRIEF SUMMARY

Embodiments of the present disclosure provide a display device capable of accurately performing a sampling operation even within one short horizontal period 1H in the display device including an internal compensation circuit.

One embodiment is a display device including: a display panel having a plurality of gate lines, a plurality of data lines and a plurality of subpixels disposed thereon; a gate driving circuit which, in operation, drives the plurality of gate lines; and a data driving circuit which, in operation, drives the plurality of data lines. Each of the plurality of subpixels includes: a light emitting device; a driving transistor which includes a first node connected to a first driving voltage line, a second node that is a gate node, and a third node electrically connected to the light emitting device, wherein the driving transistor, in operation, drives the light emitting device; a first transistor electrically connected between the third node and the data line; a third transistor electrically connected between the first node and the second node; a fourth transistor electrically connected between the third node and the light emitting device; and a seventh transistor electrically connected between the third node and a second driving voltage line and applies a first voltage to the third node. The seventh transistor, in operation, performs a turn-on operation prior to the first transistor and applies the first voltage to the third node. The first voltage applied to the third node is transmitted to the second node via the first node.

The seventh transistor performs a turn-off operation prior to a point of time when the first transistor performs the turn-on operation.

The third transistor performs the turn-on operation prior to the first transistor.

The third transistor performs a turn-off operation prior to a point of time when the fourth transistor performs the turn-on operation.

The third transistor performs the turn-on operation prior to the seventh transistor performing the turn-on operation.

The first voltage is less than a high potential power supply voltage which is supplied to the first node through the first driving voltage line.

The first voltage is higher than a data voltage which is supplied to the third node through the first transistor.

The first voltage is higher than the data voltage by a constant K, and the constant K is less than a value obtained by subtracting the data voltage of a maximum gradation from the high potential power supply voltage.

Each of the plurality of subpixels further includes a fifth transistor electrically connected between the first node and the first driving voltage line, and the fourth transistor and the fifth transistor perform a turn-off operation in a period in which the third transistor and the first transistor perform the turn-on operation.

Another embodiment is a display device including: a display panel having a plurality of gate lines, a plurality of data lines and a plurality of subpixels disposed thereon; a data driving circuit which, in operation, provides a data signal to the data lines; and a gate driving circuit which, in operation, provides a gate signal to the gate lines. Each of the plurality of subpixels includes: a light emitting device; a second transistor which includes a first node electrically connected to a first driving voltage line, a second node that is a gate node, and a third node electrically connected to the light emitting device, wherein the second transistor, in operation, drives the light emitting device; a first transistor electrically connected between the third node and the data line; a third transistor electrically connected between the first node and the second node; a fourth transistor which includes the third node and a fourth node electrically connected to the light emitting device; a fifth transistor electrically connected between the first node and the first driving voltage line; a sixth transistor electrically connected between the light emitting device and an initialization voltage line; a seventh transistor electrically connected between the third node and a second driving voltage line; and a capacitor electrically connected between the second node and the fourth node. The gate signal includes: a first scan signal which controls an on/off operation of the third transistor and the sixth transistor; a second scan signal which controls an on/off operation of the first transistor; a third scan signal which controls an on/off operation of the seventh transistor; a first light emission signal which controls an on/off operation of the fourth transistor; and a second light emission signal which controls an on/off operation of the fifth transistor. A point of time when the third scan signal is switched from a low level to a high level is earlier than a point of time when the second scan signal is switched from a low level to a high level.

A point of time when the first scan signal is switched from a high level to a low level is later than a point of time when the third scan signal is switched from a high level to a low level.

A point of time when the first scan signal is switched from a low level to a high level is earlier than a point of time when the third scan signal is switched from a low level to a high level.

A point of time when the first scan signal is switched from a high level to a low level is earlier than a point of time when the first light emission signal is switched from a low level to a high level.

A first voltage which is supplied to the third node through the second driving voltage line is less than a high potential power supply voltage which is supplied to the first node through the first driving voltage line.

The first voltage is higher than a data voltage which is supplied to the third node through the first transistor.

The first voltage is higher than the data voltage by a constant K, and wherein the constant K is less than a value obtained by subtracting the data voltage of a maximum gradation from the high potential power supply voltage.

BRIEF DESCRIPTION OF THE SEVERAL VIEWS OF THE DRAWINGS

The accompanying drawings, which are included to provide a further understanding of the disclosure and are incorporated in and constitute a part of this specification, illustrate embodiments of the disclosure and together with the description serve to explain the principles of the disclosure. In the drawings.

DETAILED DESCRIPTION

Hereinafter, exemplary embodiments of the present disclosure will be described with reference to the accompanying drawings. Throughout the disclosure, the same references mean substantially the same components. In the following description, the detailed description of known functions and configurations incorporated and related to the present disclosure is omitted when it may make the subject matter of the present disclosure rather unclear. Also, the component names used in the following description may be selected in consideration of making it easier to write the specification and may be different from the component names of an actual product.

In describing the components of the present disclosure, terms such as the first, the second, A, B, (a), (b), etc., can be used. Such terms are used only to distinguish one component from other components, and the essence, order, or number, etc., of the component are not limited by the terms. When it is said that a component is "connected," "coupled" or "accessed" to another component, it should be understood that not only the component may be directly connected or accessed to that other component, but also another component may be "interposed" between respective components or each component may be "connected," "coupled," or "accessed" by other components.

Figure 1:
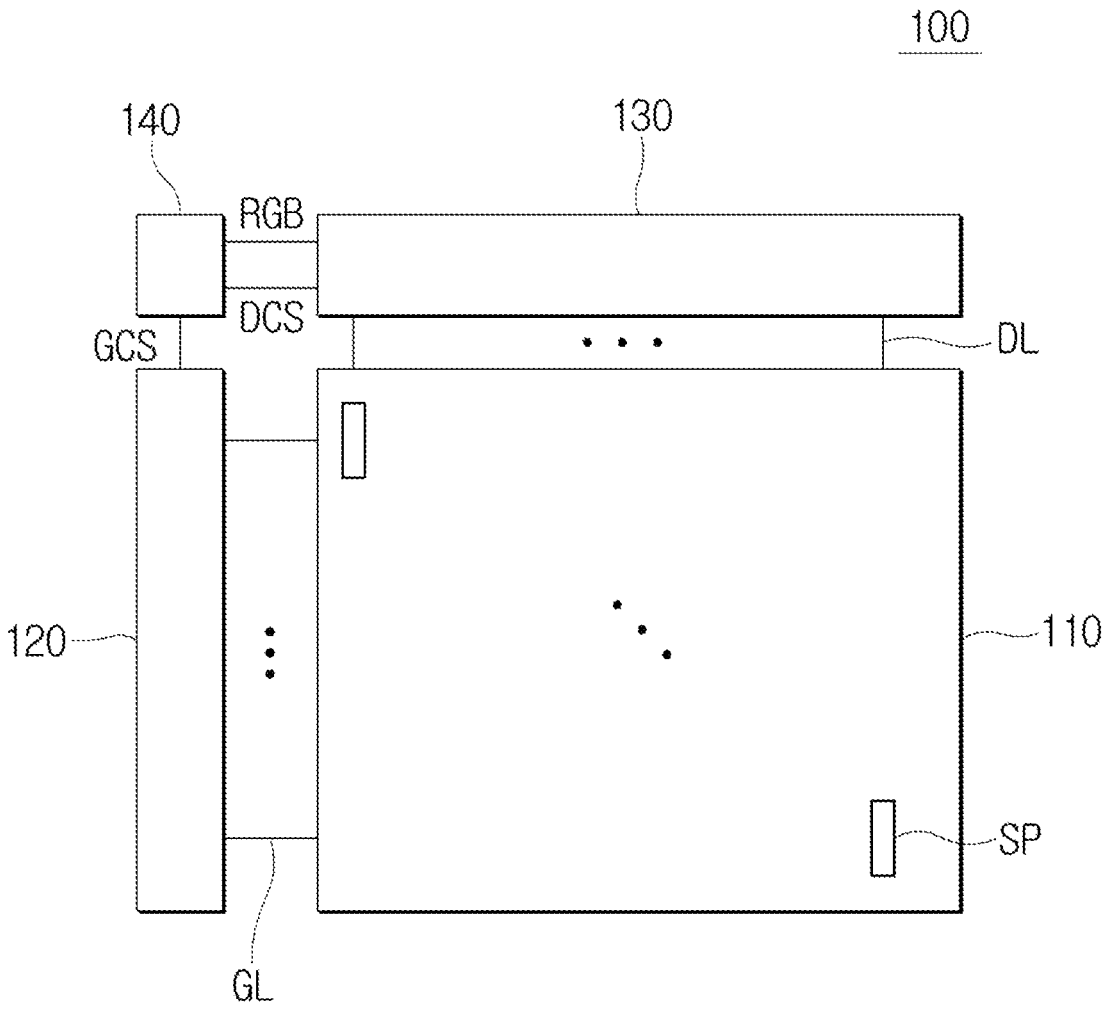
FIG. 1 shows a schematic configuration of a display device according to an embodiment.

FIG. 1 shows a schematic configuration of a display device 100 according to the embodiments of the present disclosure.

Referring to FIG. 1, the display device 100 according to embodiments of the present disclosure includes a display panel 110 in which a plurality of subpixels SP are arranged, a gate driving circuit 120, a data driving circuit 130, and a controller 140 which are for driving the display panel 110, and the like. The controller 140 may be or include controller circuitry 140, and may be referred to as the controller circuitry 140.

In the display panel 110, a plurality of gate lines GL and a plurality of data lines DL are arranged, and the subpixel SP is arranged in a region of overlap of the gate line GL and the data line DL.

The gate driving circuit 120 is controlled by the controller 140, and sequentially outputs a scan signal to the plurality of gate lines GL arranged on the display panel 110 to control a drive timing of the plurality of subpixels SP.

In some cases, such a gate driving circuit 120 may output a scan signal for controlling the drive timing of the subpixel SP and a light emission signal for controlling a light emission timing of the subpixel SP. In this case, the circuit for outputting the scan signal and the circuit for outputting the light emission signal may be implemented as separate circuits or as a single circuit.

The gate driving circuit 120 may include one or more gate driver integrated circuits (GDIC), and may be located on only one side or on both sides of the display panel 110 depending on the driving method.

Each gate driver integrated circuit (GDIC) may be connected to a bonding pad of the display panel 110 by a tape automated bonding (TAB) method or by a chip on glass (COG) method, or may be implemented in a Gate-In Panel (GIP) type and disposed directly on the display panel 110. In some cases, each gate driver integrated circuit (GDIC) may be integrated and disposed on the display panel 110. Also, each gate driver integrated circuit (GDIC) may be implemented by a chip on film (COF) method in which each gate driver integrated circuit (GDIC) is mounted on a film connected to the display panel 110.

The data driving circuit 130 receives an image data from the controller 140 and converts the image data into a data voltage in analog form. Also, the data driving circuit 130 outputs the data voltage to each data line DL in accordance with a timing at which the scan signal is applied through the gate line GL, so that each subpixel SP represents brightness according to the image data.

The data driving circuit 130 may include one or more source driver integrated circuits (SDIC).

Each source driver integrated circuit (SDIC) may include a shift register, a latch circuit, a digital to analog converter (DAC), an output buffer, and the like.

Each source driver integrated circuit (SDIC) may be connected to a bonding pad of the display panel 110 by the tape automated bonding (TAB) method or by the chip on glass (COG) method, or may be directly disposed on the display panel 110, or, in some cases, may be integrated and disposed on the display panel 110. Also, each source driver integrated circuit (SDIC) may be implemented in a chip on film (COF) method. In this case, each source driver integrated circuit (SDIC) may be mounted on a film connected to the display panel 110 and may be electrically connected to the display panel 110 through wires on the film.

The controller 140 supplies various control signals to the gate driving circuit 120 and the data driving circuit 130 and controls operations of the gate driving circuit 120 and the data driving circuit 130.

The controller 140 may be mounted on a printed circuit board, a flexible printed circuit, etc., and may be electrically connected to the gate driving circuit 120 and the data driving circuit 130 through the printed circuit board, the flexible printed circuit, etc.

The controller 140 causes the gate driving circuit 120 to output a scan signal according to a timing generated in each frame, converts an image data received from the outside in accordance with a data signal format used by the data driving circuit 130, and outputs the converted image data RGB to the data driving circuit 130.

The controller 140 receives, together with the image data, various timing signals including a vertical synchronization signal VSYNC, a horizontal synchronization signal HSYNC, an input data enable signal DE, and a clock signal CLK from the outside (e.g., a host system).

The controller 140 may generate various control signals by using various timing signals received from the outside and may output them to the gate driving circuit 120 and the data driving circuit 130.

For example, in order to control the gate driving circuit 120, the controller 140 outputs various gate control signals GCS including a gate start pulse (GSP), a gate shift clock (GSC), a gate output enable signal (GOE), etc.

Here, the gate start pulse (GSP) controls an operation start timing of one or more gate driver integrated circuits (GDIC) which constitutes the gate driving circuit 120. The gate shift clock (GSC) is a clock signal which is commonly input to one or more gate driver integrated circuits (GDIC). The gate shift clock (GSC) controls a shift timing of the scan signal. The gate output enable signal (GOE) designates timing information of one or more gate driver integrated circuits (GDIC).

Also, in order to control the data driving circuit 130, the controller 140 outputs various data control signals DCS including a source start pulse (SSP), a source sampling clock (SSC), a source output enable signal (SOE), etc.

Here, the source start pulse (SSP) controls a data sampling start timing of one or more source driver integrated circuits (SDIC) which constitutes the data driving circuit 130. The source sampling clock (SSC) is a clock signal which controls a sampling timing of data in each of the source driver integrated circuits (SDIC). The source output enable signal (SOE) controls an output timing of the data driving circuit 130.

The display device 100 may further include a power management integrated circuit (not shown) which supplies various voltages or currents to the display panel 110, the gate driving circuit 120, the data driving circuit 130, etc., or controls various voltages or currents to be supplied.

Each subpixel SP may be arranged in a region of overlap of the gate line GL and the data line DL, and a liquid crystal or a light emitting device EL may be disposed depending on the type of the display device 100.

Figure 2:
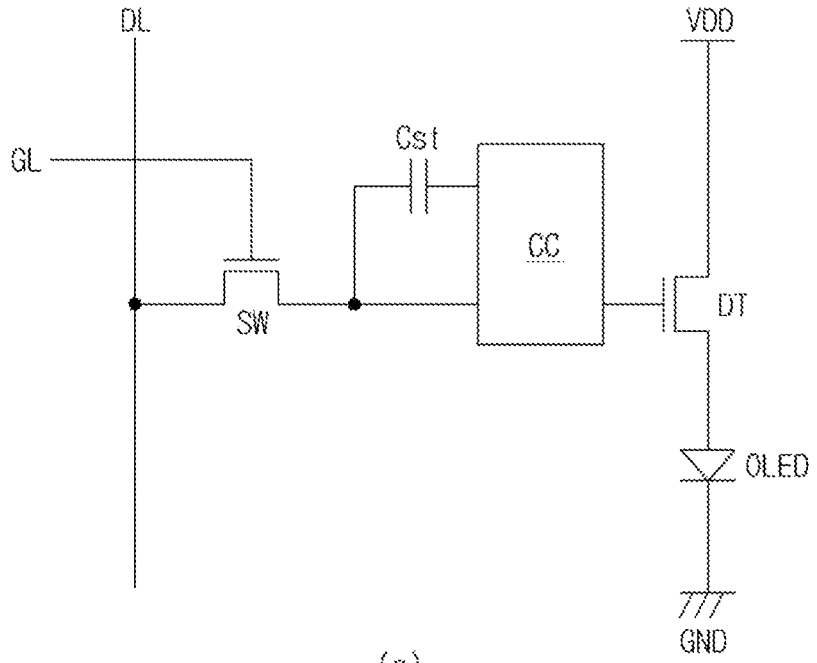
FIG. 2 shows an example of a subpixel structure.
Figure 2:
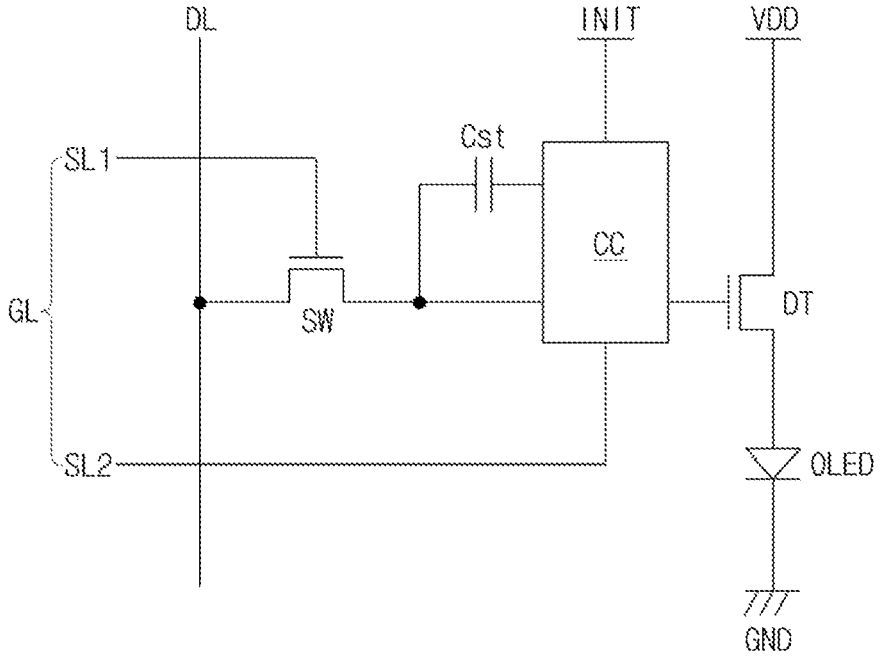

An example of a subpixel structure according to the embodiment is shown in (a) and (b) of FIG. 2.

Referring to (a) of FIG. 2, one subpixel includes a switching transistor SW, a driving transistor DT, a compensation circuit CC, and an organic light emitting diode OLED. The organic light emitting diode OLED operates to emit light in accordance with a driving current generated by the driving transistor DT.

The switching transistor SW performs a switching operation such that a data signal supplied through the data line DL in response to a gate signal supplied through the gate line GL is stored as a data voltage in a capacitor Cst. The driving transistor DT operates such that a driving current flows between a high potential power supply voltage VDD and a low potential power supply voltage GND in accordance with the data voltage stored in the capacitor Cst. The compensation circuit CC is for compensating a threshold voltage Vth of the driving transistor DT, etc. Meanwhile, according to various embodiments, the capacitor Cst electrically connected to the switching transistor SW or the driving transistor DT may be located within the compensation circuit CC.

The compensation circuit CC includes one or more thin film transistors and a capacitor. The compensation circuit CC may be configured in a wide variety of ways according to a compensation method.

Also, as shown in (b) of FIG. 2, when the compensation circuit CC is included, the subpixel may further include a signal line SL1 and SL2 (e.g., gate line GL), a power line INIT, etc., which are for driving a compensation thin film transistor and for supplying a specific signal or electric power.

Hereinafter, a case in which the compensation circuit CC includes four transistors will be described as an example.

Figure 3:
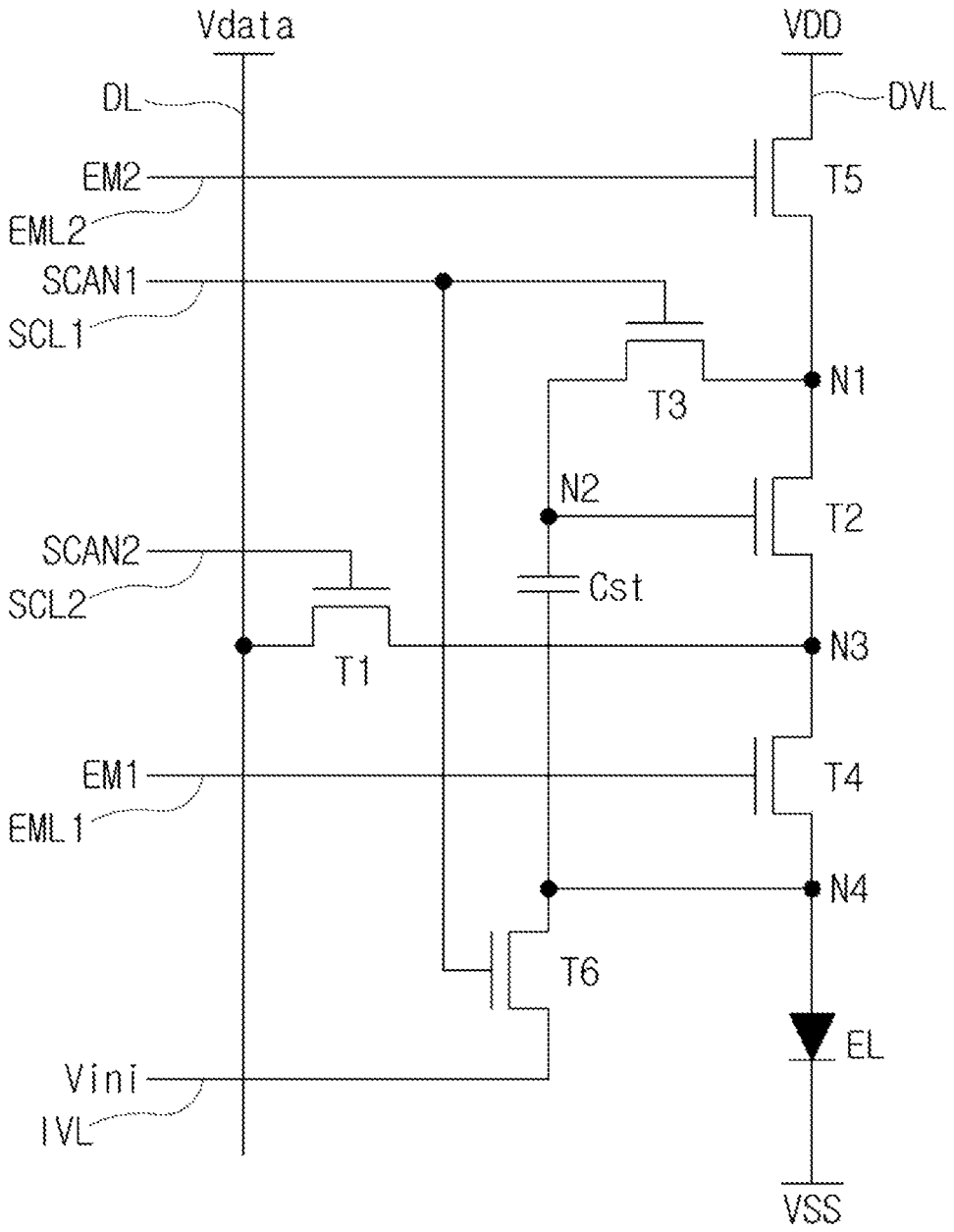
FIG. 3 shows an example of the structure of a subpixel circuit arranged in the display device according to the embodiments.

FIG. 3 shows an example of a circuit structure of the subpixel arranged in the display device according to the embodiments.

Referring to FIG. 3, in the subpixel SP of the display device 100 according to embodiments of the present disclosure, for example, a light emitting device EL, a plurality of transistors T1, T2, T3, T4, T5, and T6, and one capacitor Cst may be disposed. Here, T3, T4, T5, and T6 correspond to the compensation circuit CC described with reference to FIG. 2.

Meanwhile, in the example shown in FIG. 3, the subpixel SP having a six transistor, one capacitor ("6T1C") structure is shown as an example. However, a circuit element disposed in the subpixel SP can be implemented in various ways depending on the type of the display device 100. Also, although FIG. 3 shows that the transistor disposed in the subpixel SP is an N-type transistor, the subpixel SP may be composed of a P-type transistor in some cases. When the subpixel SP is composed of a P-type transistor, scan waveforms SCAN1 and SCAN2 may have a polarity opposite to that of the scan waveforms of the subpixel SP composed of an N-type transistor.

When the subpixel SP is composed of 6T1C, the six transistors T1, T2, T3, T4, T5, and T6 and one capacitor Cst may be disposed in each subpixel SP.

The first transistor T1 may be controlled by a second scan signal SCAN2 applied to a second scan line SCL2 and may be electrically connected between a third node N3 and the data line DL to which the data voltage Vdata is applied. Such a first transistor T1 may also be referred to as "scan transistor."

The second transistor T2 may have a first node N1, a second node N2, and a third node N3. The first node N1 may be a drain node or a source node and may be electrically connected to a driving voltage line DVL. The second node N2 may be a gate node. The third node N3 may be a source node or a drain node and may be electrically connected to an anode electrode of the light emitting device EL. Such a second transistor T2 may also be referred to as a "driving transistor."

The third transistor T3 is controlled by a first scan signal SCAN1 applied to a first scan line SCL1 and may be electrically connected between the second node N2 and the first node N1 of the second transistor T2. Such a third transistor T3 may also be referred to as a "compensation transistor".

The fourth transistor T4 may be controlled by a first light emission signal EM1 applied to a first light emission control line EML1 and may be electrically connected between the third node N3 and the fourth node N4. Such a fourth transistor T4 may also be referred to as a "first light emitting transistor."

The fifth transistor T5 may be controlled by a second light emission signal EM2 applied to a second light emission control line EML2 and may be electrically connected between the driving voltage line DVL and the first node N1. Such a fifth transistor T5 may also be referred to as a "second light emitting transistor."

The sixth transistor T6 may be controlled by the first scan signal SCAN1 applied to the first scan line SCL1 and may be electrically connected between an initialization voltage line IVL and the fourth node N4. Such a sixth transistor T6 may also be referred to as an "initialization transistor."

The capacitor Cst may be electrically connected between the second node N2 and the fourth node N4 and can maintain the data voltage Vdata for one frame.

The light emitting device EL is electrically connected between the fourth node N4 and a line to which a ground voltage VSS is applied, and may be, for example, an organic light emitting diode (OLED).

Figure 4A:
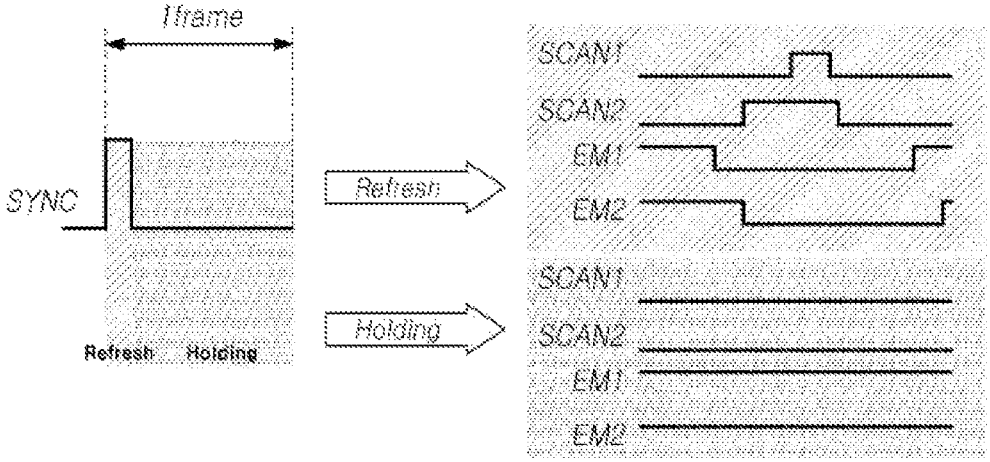
FIGS. 4A and 4B show an example of a drive timing of the subpixel shown in FIG. 3.
Figure 4B:
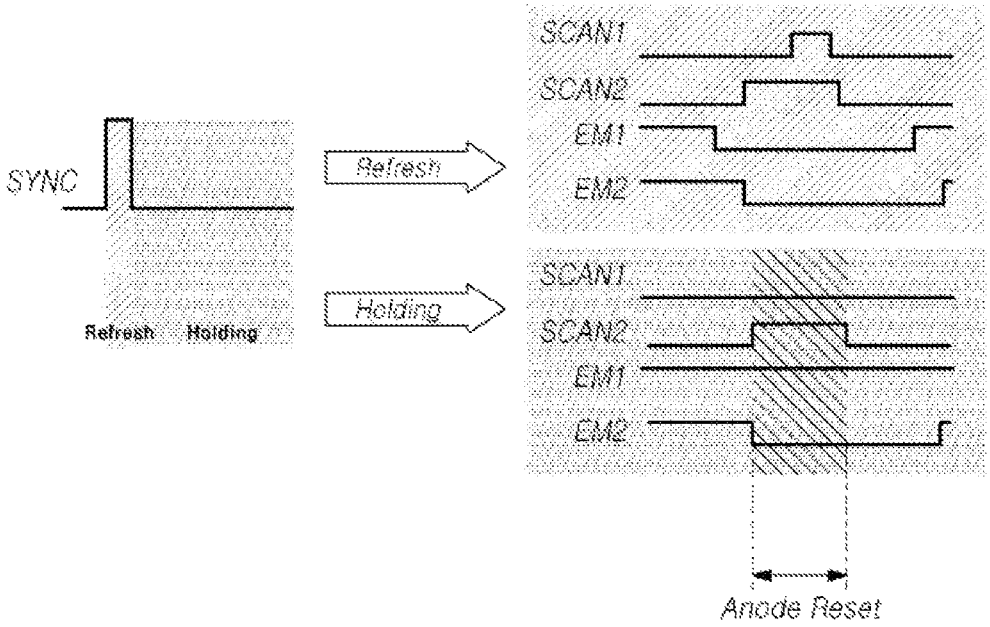

FIGS. 4A and 4B show an example of the drive timing of the subpixel shown in FIG. 3.

Referring to FIGS. 4A and 4B, one frame period may be divided into a refresh period and a holding period in accordance with a synchronization signal SYNC.

The display device according to the embodiment may operate in a low-speed driving mode and a high-speed driving mode. In the low-speed driving mode, the display device controls the holding period to be longer for a unit time and controls the refresh period to be shorter. When the display device operates at a low speed, power consumption can be reduced.

The refresh period may be subdivided into an initialization period, a sampling period, a programming period, and a light emission period.

During the initialization period, the data voltage written in the light emitting device EL is initialized by applying an initialization voltage Vini to the subpixel SP. During the sampling period, the threshold voltage Vth of the driving transistor T2 is stored in the capacitor connected to the driving transistor T2. During the programming period, the data voltage Vdata is applied to the subpixel SP, and thus, the data voltage Vdata is stored in the capacitor connected to the driving transistor T2.

The sampling period and the programming period are conceptually distinguished. The sampling period and the programming period are separated from each other according to the subpixel structure so that the operations in the periods may be sequentially performed or may be performed at the same time. In the subpixel structure described in the embodiment of the present disclosure, the operations in the sampling period and the operations in the programming period may be performed simultaneously. Hereinafter, the sampling period will be described with the inclusion of programming period.

During the holding period, the data voltage is not supplied through the data lines connected to the light emitting devices, respectively, and the light emitting devices emit light by using the data voltage stored in a refresh frame as it is.

In FIG. 4A, the holding period includes only the light emission period, and FIG. 4B includes an anode reset period.

In FIG. 4A, during the holding period, the first scan signal SCAN1 and the second scan signal SCAN2 maintain a low level, and the first light emission signal EM1 and the second light emission signal EM2 maintain a high level.

According to various embodiments, an anode reset voltage for resetting the anode electrode of the light emitting device EL may be supplied through the data line DL during the holding period.

As shown in FIG. 4B, in the holding period, during a period in which the anode electrode of the light emitting device EL is reset, the second scan signal SCAN2 may be applied at a high level, and the second light emission signal EM2 may be applied at a low level. That is, in a state where the low level of the first scan signal SCAN1 and the high level of the first light emission signal EM1 are maintained, the levels of the second scan signal SCAN2 and the second light emission signal EM2 may be changed. The reset voltage may be supplied through the data line DL in a period in which the second scan signal SCAN2 is applied at a high level.

Hereinafter, a process in which a subpixel is driven according to the initialization period, sampling period, and light emission period will be described in detail with reference to FIGS. 5 to 7.

In FIGS. 4A and 4B, a case in which the second scan signal SCAN2 is applied at a high level prior to the first scan signal SCAN1 has been described as an example. In FIGS. 5 to 7, a case in which the first scan signal SCAN1 is applied at a high level prior to the second scan signal SCAN2 will be described as an example.

Figure 5:
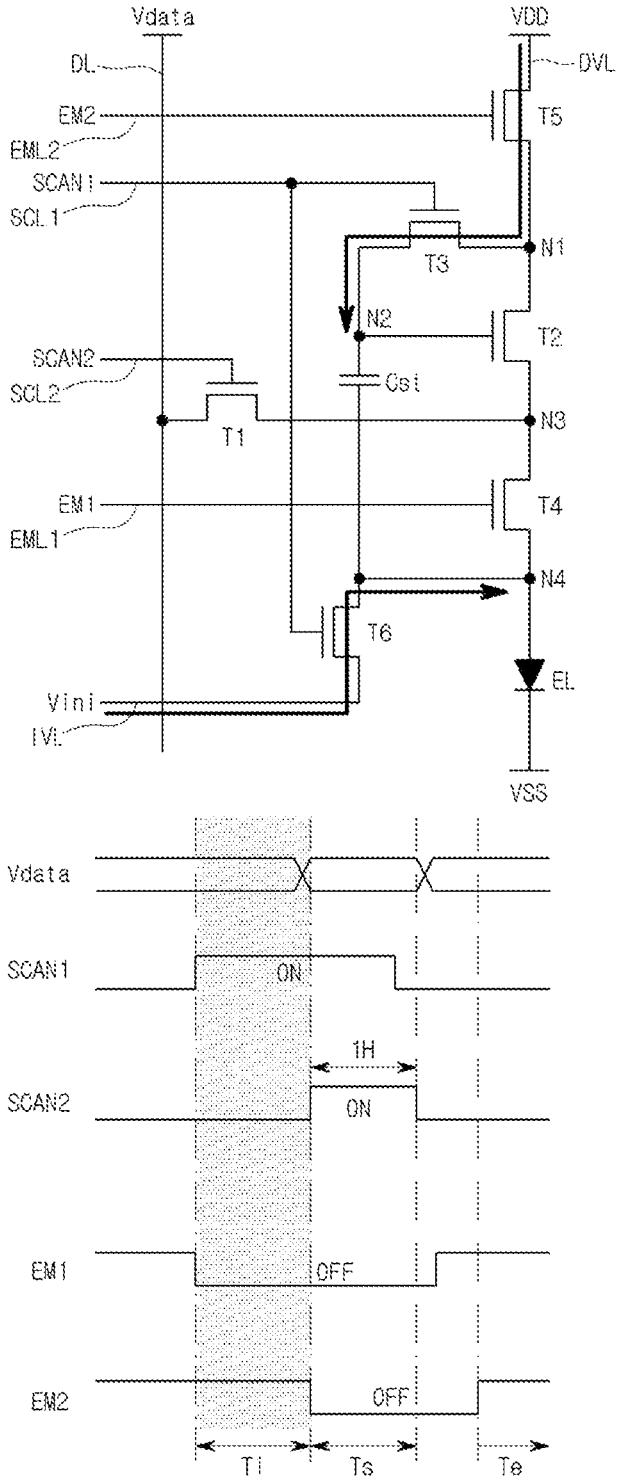
FIGS. 5 to 7 show an example of a process of driving the subpixel circuit.
Figure 6:
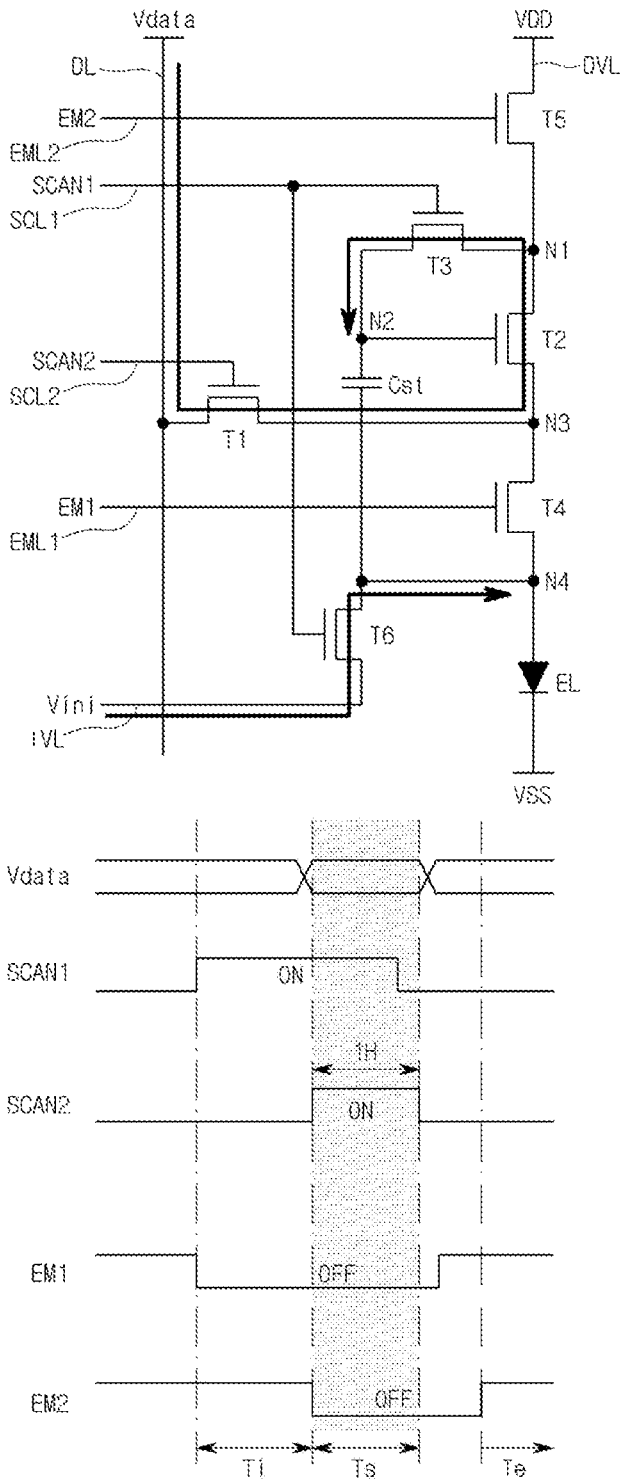
Figure 7:
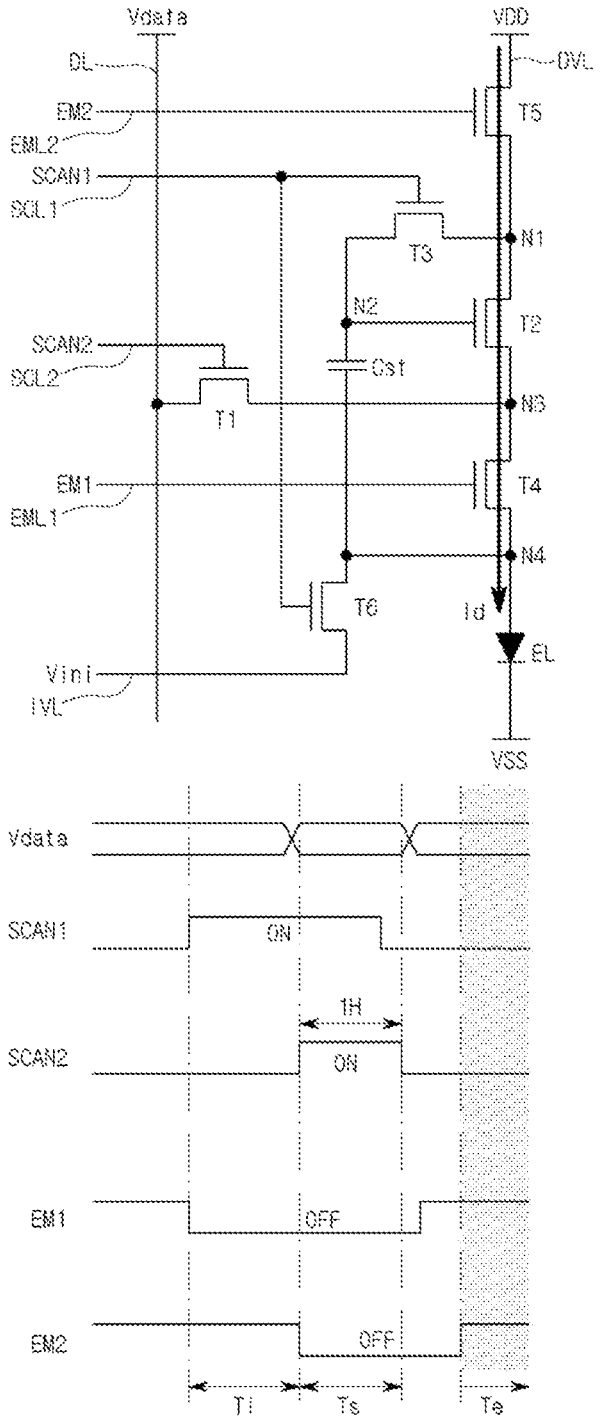

FIGS. 5 to 7 show an example of a process of driving the subpixel.

Initialization Period Ti

FIG. 5 shows the initialization period. During the initialization period Ti, the fourth node N4 to which the anode electrode of the light emitting device EL of the subpixel SP is connected is initialized. Also, the second node N2 connected to the gate electrode of the second transistor T2 which corresponds to the driving transistor is initialized to the high potential power supply voltage VDD.

In the initialization period, in a state in which the first scan signal SCAN1 is applied at a high level ON and the second scan signal SCAN2 is applied at a low level, the first light emission signal EM1 is applied at a low level and the second light emission signal EM2 is applied at a high level.

Since the first scan signal SCAN1 is applied at a high level, the third transistor T3 and the sixth transistor T6 are turned on. Also, since the second light emission signal EM2 is applied at a high level, the fifth transistor T5 is turned on.

Also, since the second scan signal SCAN2 is applied at a low level, the first transistor T1 is turned off. Also, since the first light emission signal EM1 is applied at a low level OFF, the fourth transistor T4 is turned off.

Since the third transistor T3 and the fifth transistor T5 are in a turned-on state, the high potential power supply voltage VDD is applied to the second node N2 via the fifth transistor T5 and the third transistor T3.

Since the sixth transistor T6 is in a turned-on state, the initialization voltage Vini is applied to the fourth node N4, and the data voltage Vdata and the initialization voltage Vini may be applied to both ends of the capacitor Cst.

Sampling Period Ts

FIG. 6 shows the sampling period. During one horizontal period, the data voltage Vdata is supplied to the capacitor Cst of the subpixel, and the data voltage Vdata compensated by as much as the threshold voltage Vth of the second transistor T2 which corresponds to the driving transistor is charged in the capacitor Cst. One horizontal period is a time in which data is written to the pixels arranged in one horizontal line on the screen. In other words, one horizontal period 1H is a period in which the first transistor T1 is turned on. During one horizontal period, the data voltage Vdata is written to each subpixel. Meanwhile, in that information on the threshold voltage Vth of the second transistor T2 which corresponds to the driving transistor is stored in the capacitor Cst connected to the second node N2, this period is also referred to as a sampling period Ts.

In a state where the first scan signal SCAN1 and the second scan signal SCAN2 are applied at a high level in the sampling period Ts, the first light emission signal EM1 and the second light emission signal EM2 are applied at a low level.

Since the first scan signal SCAN1 and the second scan signal SCAN2 are applied at a high level, the first transistor T1, the second transistor T2, the third transistor T3, and the sixth transistor T6 are turned on.

Also, since the first light emission signal EM1 and the second light emission signal EM2 are applied at a low level, the fourth transistor T4 and the fifth transistor T5 are turned off.

Since the sixth transistor T6 is still in a turned-on state, the initialization voltage Vini may be applied to the fourth node N4.

Since the first transistor T1 is in a turned-on state, the data voltage Vdata may be applied to the third node N3. Since the third transistor T3 is in a turned-on state, the data voltage Vdata applied to the third node N3 is applied to the second node N2 via the first node N1. Here, a voltage obtained by subtracting the threshold voltage Vth of the second transistor T2 from the data voltage Vdata, that is, a value of "Vdata-Vth" may be applied to the second node N2. Accordingly, the driving current Id which is supplied to the light emitting device by the second transistor T2 is not affected by the threshold voltage Vth. That is, the threshold voltage Vth of the second transistor T2 is compensated.

That is, in the sampling period Ts, the compensation circuit performs a sampling operation of saturating the second transistor T2 to a certain level by increasing a gate voltage of the second transistor T2 that is the driving transistor to a certain level in a source follower manner.

Meanwhile, as a resolution increases and a driving frequency increases, one horizontal period 1H during which data is written to the pixels in one line in the display panel is reduced. Accordingly, a duration of the sampling period Ts is also reduced, and the gate voltage of the second transistor T2 may not be saturated to a desired level. As a result, the information on the threshold voltage Vth of the second transistor T2 stored in the capacitor Cst connected to the second node N2 has an error. The error of the information on the threshold voltage Vth will be described in more detail with reference to FIG. 8.

Light Emission Period Te

FIG. 7 shows the light emission period. The current Id corresponding to the data voltage Vdata flows through the second transistor T2 in the subpixel SP during the light emission period Te, and the light emitting device EL starts to emit light.

In the light emission period Te, the first scan signal SCAN1 and the second scan signal SCAN2 are applied at a low level, and the first light emission signal EM1 and the second light emission signal EM2 are applied at a high level.

Accordingly, in a state where the first transistor T1, the third transistor T3, and the sixth transistor T6 are in a turned-off state, the fourth transistor T4 and the fifth transistor T5 are turned on.

Since the data voltage Vdata has been applied to the gate node of the second transistor T2 and the initialization voltage Vini has been applied to the fourth node N4, the current Id corresponding to the data voltage Vdata flows through the second transistor T2, and the light emitting device EL starts to emit light.

Figure 8:
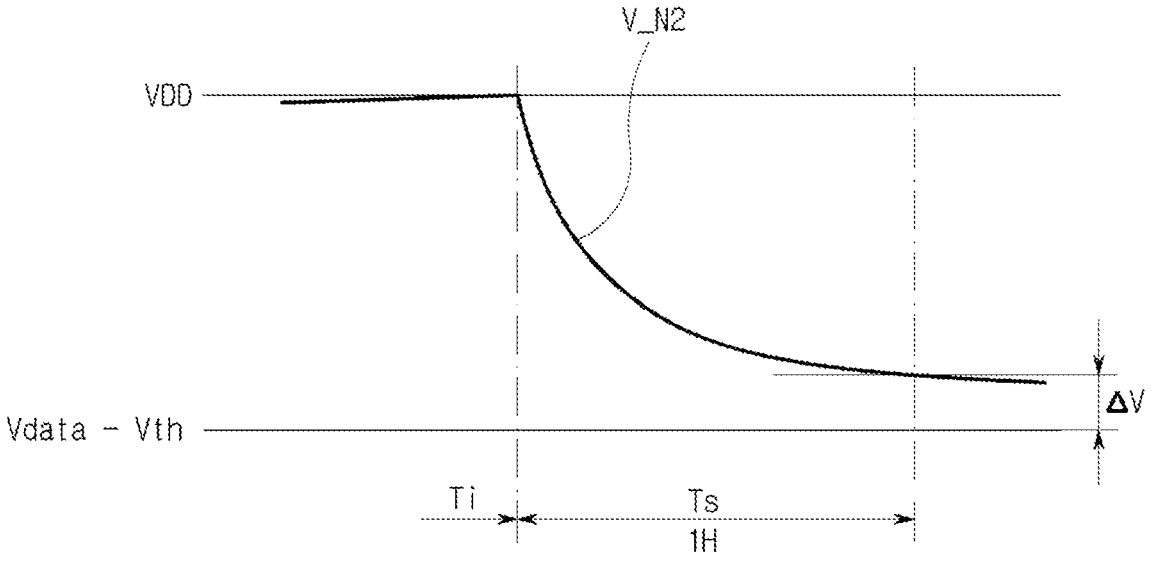
FIG. 8 shows a voltage change of a second node during a sampling period shown in FIG. 3.

FIG. 8 shows a voltage change of the second node during the sampling period shown in FIG. 3.

In order to exclude the influence of the threshold voltage Vth of the driving transistor T2 in the operation of an internal compensation circuit during the light emission period Te, it may be beneficial for the second node N2 to be sufficiently saturated to a value of "Vdata−Vth" during the sampling period Ts.

As the resolution increases and the driving frequency increases, one horizontal period 1H during which data is written to the pixels in one line in the display panel is reduced. During the sampling period Ts of one horizontal period 1H, the value of the second node N2 is not saturated to a sufficient value, and thus a sampling deviation_V occurs. As a result, an error occurs in an internal compensation value.

As described with reference to FIG. 5, the second node N2 is initialized to the high potential power supply voltage VDD during the initialization period Ti.

Since one horizontal period 1H is not sufficient, as shown in FIG. 8, the voltage V_N2 of the second node N2 is not sufficiently saturated to a target voltage value "Vdata−Vth" during the sampling period Ts, so that the sampling deviation ΔV may occur. The sampling deviation ΔV causes a difference in drive characteristics between the pixels. Even though data of the same gradation is written to substantially all the pixels, the difference in drive characteristics between the pixels causes a difference in luminance, and as a result, spots may be seen on the screen.

Figure 9:
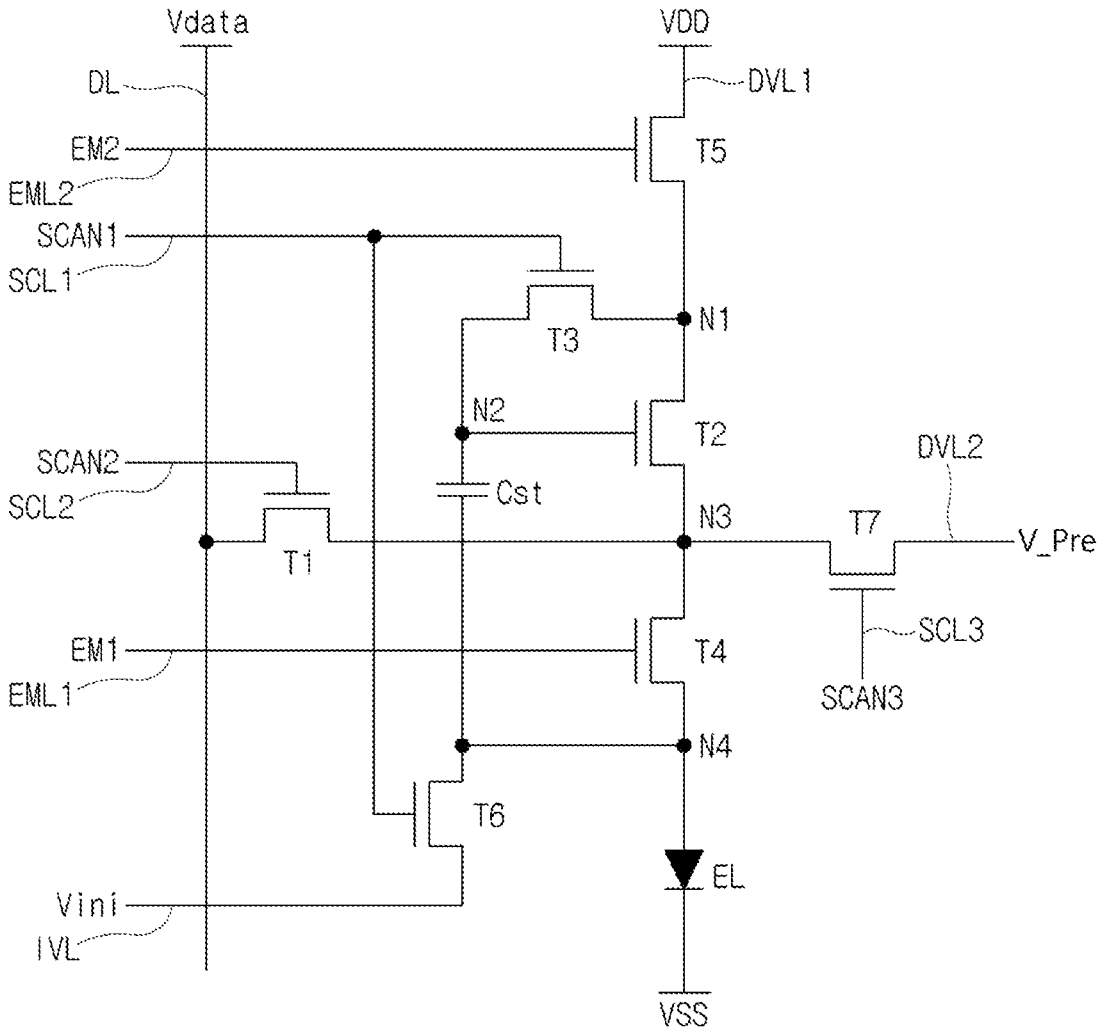
FIG. 9 shows an example of the structure of the subpixel circuit having a seventh transistor added thereto.
Figure 10:
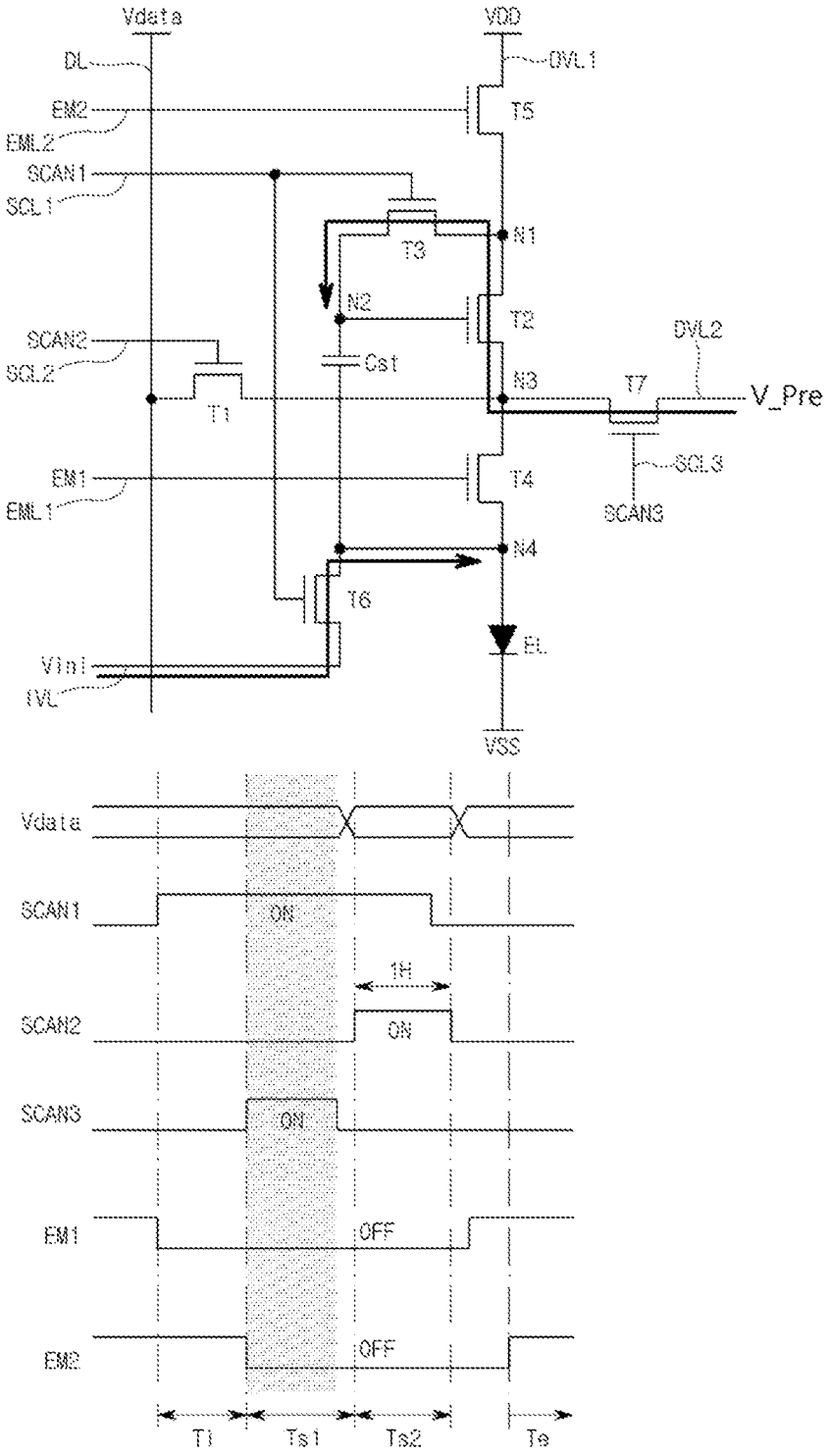
FIG. 10 shows an example of a process of driving the subpixel circuit during a first sampling period of FIG. 9.
Figure 11:
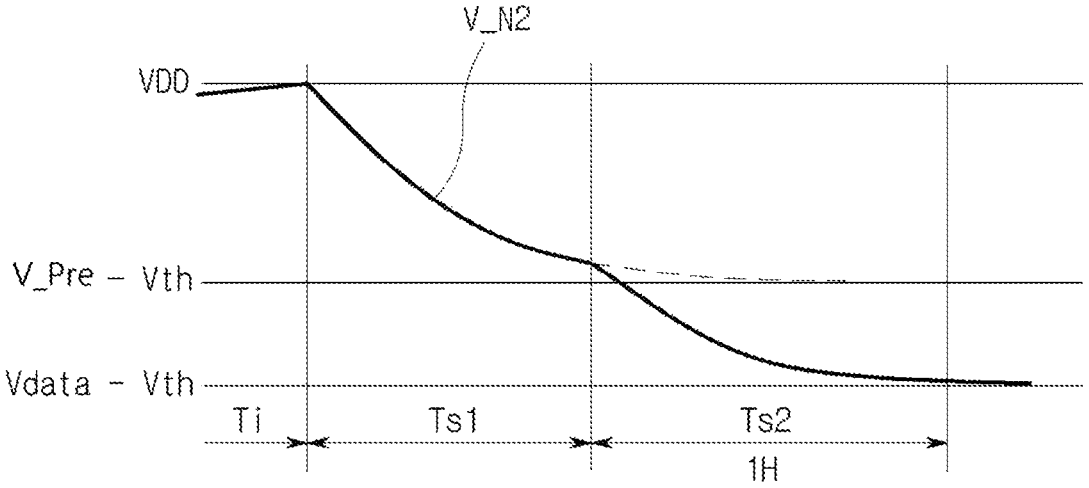
FIG. 11 shows a voltage change of the second node shown in FIG. 9 during the first and second sampling periods.

FIG. 9 shows an example of the structure of the subpixel circuit having a seventh transistor added thereto. FIG. 10 shows an example of a process of driving the subpixel circuit during a first sampling period of FIG. 9. FIG. 11 shows a change in a voltage V_N2 of the second node shown in FIG. 9 during the first and second sampling periods.

The display device according to the embodiments of FIGS. 9 and 10 is characterized in that the threshold voltage Vth of the driving transistor is sampled in advance before one horizontal period 1H. As a means for this, the subpixel of the display device according to the embodiments of FIGS. 9 and 10 further includes the seventh transistor.

In the subpixel SP of the display device 100 according to embodiments of the present disclosure, for example, the light emitting device EL, the plurality of transistors T1, T2, T3, T4, T5, T6, and T7 for driving the light emitting device EL, and one capacitor Cst may be disposed. Here, T3, T4, T5, T6, and T7 correspond to the compensation circuit CC described with reference to FIG. 2.

The seventh transistor T7 may be controlled by a third scan signal SCAN3 which is applied to a third scan line SCL3 and may be electrically connected to the third node N3 and a second driving voltage line DVL2 to which a pre-driving voltage V_Pre is applied. The seventh transistor T7 may be referred to as a "pre-driving transistor."

The descriptions of the first to sixth transistors T1 to T6 and one capacitor Cst are the same as those described with reference to FIG. 3, and thus, will be omitted.

Referring to FIG. 10, the display device performs a first sampling Ts1 between the initialization period and one horizontal period 1H. The period of first sampling Ts1 is a period in which the threshold voltage Vth of the second transistor T2 is sampled in advance before a period of a second sampling Ts2 which is driven based on an actual image data voltage Vdata.

In the period of the first sampling Ts1, in a state where the first scan signal SCAN1 and the third scan signal SCAN3 are applied at a high level, the second scan signal SCAN2, the first light emission signal EM1, and the second light emission signal EM2 are applied at a low level.

Since the first scan signal SCAN1 and the third scan signal SCAN3 are applied at a high level, the second transistor T2, the third transistor T3, the sixth transistor T6, and the seventh transistor T7 are turned on.

Also, since the second scan signal SCAN2, the first light emission signal EM1, and the second light emission signal EM2 are applied at a low level, the first transistor T1, the fourth transistor T4, and the fifth transistor T5 are turned off.

Since the sixth transistor T6 is still in a turned-on state, the initialization voltage Vini may be applied to the fourth node N4.

Since the seventh transistor T7 is in a turned-on state, the pre-driving voltage V_Pre may be applied to the third node N3. That is, the seventh transistor T7 may perform a turn-on operation prior to the first transistor T1 and apply the pre-driving voltage V_Pre to the third node N3. As shown in FIG. 10, a point of time when the third scan signal SCAN3 is switched from a low level to a high level is earlier than a point of time when the second scan signal SCAN2 is switched from a low level to a high level. Also, since the third transistor T3 is in a turned-on state, the pre-driving voltage V_Pre applied to the third node N3 is applied to the second node N2 via the first node N1. Here, a voltage obtained by subtracting the threshold voltage Vth of the second transistor T2 from the pre-driving voltage V_Pre, that is, a value of "V_Pre−Vth" may be applied to the second node N2. However, when the period of the first sampling Ts1 is not sufficient, the voltage of the second node N2 may not be sufficiently saturated to "V_Pre−Vth" in the same principle as that described with reference to FIG. 8.

The second sampling Ts2 will be described with reference to FIGS. 10 and 6.

First, as mentioned above, it has been described that as a resolution increases and a driving frequency increases, one horizontal period 1H during which data is written to the pixels in one line in the display panel is reduced, and thus, there is not enough time to sample the threshold voltage Vth of the driving transistor, so that the threshold voltage Vth is incorrectly sensed. Also, this causes a difference in drive characteristics between the pixels, and as a result, spots may be seen on the display device. If the sampling period Ts is not sufficiently given, the voltage of the second node N2 may not be saturated to the target value "Vdata−Vth." This is because there is a big difference between the voltage value VDD of the second node N2 and the target value "Vdata−Vth" at a point of time when the sampling is started.

In order to solve this problem, the inventor of the present disclosure samples in advance the threshold voltage Vth of the driving transistor before one horizontal period 1H, so that the inventor has found a solution to obtain a sufficient time for sampling the threshold voltage Vth of the driving transistor even in a high-speed or high-resolution display device.

Specifically, in the display device according to the embodiment, the seventh transistor T7 charges the pre-driving voltage V_Pre in the third node N3 during the period of the first sampling Ts1. Then, the seventh transistor T7 performs the second sampling Ts2 subsequently to the period of the first sampling Ts1. The period of second sampling Ts2 is a sampling period in which the second sampling Ts2 is driven based on an actual image data voltage Vdata. During one horizontal period, the data voltage Vdata is supplied to the capacitor Cst of the subpixel, and the data voltage Vdata is compensated by as much as the threshold voltage Vth of the second transistor T2 which corresponds to the driving transistor is charged in the capacitor Cst. In the period of the second sampling Ts2, the driving of the subpixel is similar to that described with reference to FIG. 6. However, at a point where the second sampling Ts2 which is driven based on the actual image data voltage Vdata is started, a start value of the voltage of the second node N2, i.e., gate voltage of the second transistor T2 is different from that of FIG. 6. As an embodiment, the seventh transistor T7 may perform a turn-off operation prior to a point of time when the first transistor T1 performs the turn-on operation. As an embodiment, the third transistor T3 may perform the turn-on operation prior to the first transistor T1. As an embodiment, the third transistor T3 may perform a turn-off operation prior to a point of time when the fourth transistor T4 performs the turn-on operation. As an embodiment, the third transistor T3 may perform the turn-on operation prior to the seventh transistor T7. As shown in FIG. 10, a point of time when the first scan signal SCAN1 is switched from a high level to a low level is later than a point of time when the third scan signal SCAN3 is switched from a high level to a low level, a point of time when the first scan signal SCAN1 is switched from a low level to a high level is earlier than a point of time when the third scan signal SCAN3 is switched from a low level to a high level, and a point of time when the first scan signal SCAN1 is switched from a high level to a low level is earlier than a point of time when the first light emission signal EM1 is switched from a low level to a high level.

At a point of time when the period of the first sampling Ts1 ends, the voltage of the second node N2 is less than VDD. At a point of time when the period of the first sampling Ts1 ends, the voltage of the second node N2 may be "V_Pre−Vth" that is a target voltage value or may be "V_Pre−Vth+ΔV" that is a value slightly less than the target voltage value.

At a point of time when the second sampling is started, the voltage value of the second node N2 is "V_Pre−Vth" that is the target value of the voltage value of the second node N2 in the period of the first sampling Ts1, or is "V_Pre−Vth+ΔV" that is less than the target voltage value. Accordingly, the voltage value of the second node N2 can quickly reach the target value of the voltage of the second node N2 in the period of the second sampling Ts2.

This is because in the period of the second sampling Ts2, the difference between the start value of the voltage of the second node N2 and the target value is smaller than that of FIG. 8. Accordingly, even though one horizontal period 1H is not sufficiently obtained, the voltage value of the second node N2 can be sufficiently saturated to the target value of "Vdata−Vth." Accordingly, even though one horizontal period 1H is shortened, the voltage V_N2 of the second node, which has an exact magnitude in which the threshold voltage Vth of the second transistor T2 is reflected, can be sampled in the sampling period.

Meanwhile, during the first and second sampling periods Ts1 and Ts2, the potential of the first node should be higher than the potential of the third node. When the potential is reversed, the second node may not be saturated. Therefore, the threshold voltage Vth of the second transistor T2 may not be correctly sampled.

Therefore, the pre-driving voltage V_Pre should be lower than the high potential power supply voltage VDD, i.e., the initialization voltage of the first node N1. Also, since the period of second sampling Ts2 is a sampling period in which the second sampling Ts2 is driven based on the actual image data voltage Vdata, it may be beneficial for the pre-driving voltage V_Pre to be greater than the data voltage Vdata. This is because the potential of the first node being higher than the potential of the third node during the period of the second sampling Ts2 benefits proper sampling of the threshold voltage Vth of the second transistor T2.

As a result, in order to properly sample the threshold voltage Vth of the second transistor T2 over the first and second sampling periods Ts1 and Ts2, the magnitude of the pre-driving voltage V_Pre may satisfy the following Equation (1).

$$V\text{data} < V_\text{Pre} < VDD \qquad \text{Equation (1)}$$

The pre-driving voltage V_Pre according to the embodiment may have a voltage value having a fixed magnitude. The pre-driving voltage V_Pre may be less than the high potential power supply voltage VDD. Also, the pre-driving voltage V_Pre may be greater than Vdata_MAX, that is, the data voltage Vdata of a maximum gradation.

According to various embodiments, the pre-driving voltage V_Pre may have the same variation value as that of the data voltage Vdata. Specifically, the pre-driving voltage V_Pre may have a value obtained by adding a constant K to the data voltage Vdata. Also, the pre-driving voltage V_Pre may be lower than the high potential power supply voltage VDD. Therefore, the pre-driving voltage V_Pre may satisfy the following Equation (2).

$$V_\text{Pre} = V\text{data} + K, \text{ and } K < VDD - V\text{data_MAX} \qquad \text{Equation (2)}$$

Here, Vdata_MAX is the data voltage Vdata of the maximum gradation.

As described above, in the display device according to the embodiments of the present disclosure, the threshold voltage Vth of the driving transistor is sampled in advance before one horizontal period 1H, so that a sufficient time for sampling the threshold voltage Vth of the driving transistor can be obtained even in a high-speed or high-resolution display device. Furthermore, the compensation rate of the internal compensation circuit is improved to reduce the luminance deviation between the pixels.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

While the embodiment of the present disclosure has been described with reference to the accompanying drawings, it can be understood by those skilled in the art that the present disclosure can be embodied in other specific forms without departing from its spirit or characteristics. Therefore, the foregoing embodiments and advantages are presented as examples and are not to be construed as limiting the present disclosure. The present teaching can be readily applied to other types of apparatuses. The description of the foregoing embodiments is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A display device comprising:

a display panel having a plurality of gate lines, a plurality of data lines and a plurality of subpixels disposed thereon;

a gate driving circuit which, in operation, drives the plurality of gate lines; and a data driving circuit which, in operation, drives the plurality of data lines, wherein each of the plurality of subpixels includes:

a light emitting device;

a driving transistor which comprises a first node connected to a first driving voltage line, a second node that is a gate node, and a third node electrically connected to the light emitting device, wherein the driving transistor, in operation, drives the light emitting device;

a first transistor electrically connected between the third node and the data line;

a third transistor electrically connected between the first node and the second node;

a fourth transistor electrically connected between the third node and the light emitting device; and a seventh transistor electrically connected between the third node and a second driving voltage line, wherein the seventh transistor, in operation, applies a first voltage to the third node, wherein the seventh transistor, in operation, performs a turn-on operation prior to the first transistor and applies the first voltage to the third node, and wherein the first voltage applied to the third node is transmitted to the second node via the first node.

2. The display device of claim 1, wherein the seventh transistor, in operation, performs a turn-off operation prior to a point of time when the first transistor performs the turn-on operation.

3. The display device of claim 1, wherein the third transistor, in operation, performs the turn-on operation prior to the first transistor.

4. The display device of claim 1, wherein the third transistor, in operation, performs a turn-off operation prior to a point of time when the fourth transistor performs the turn-on operation.

5. The display device of claim 1, wherein the third transistor, in operation, performs the turn-on operation prior to the seventh transistor performing the turn-on operation.

6. The display device of claim 1, wherein the first voltage is less than a high potential power supply voltage supplied to the first node through the first driving voltage line.

7. The display device of claim 6, wherein the first voltage is higher than a data voltage supplied to the third node through the first transistor.

8. The display device of claim 7, wherein the first voltage is higher than the data voltage by a constant K, and wherein the constant K is less than a value obtained by subtracting the data voltage of a maximum gradation from the high potential power supply voltage.

9. The display device of claim 7, further comprising a capacitor electrically connected between the second node and the fourth node, wherein the capacitor, in operation, maintains the data voltage for one frame.

10. The display device of claim 9, wherein the seventh transistor, in operation, applies the first voltage to the third node during a first sampling period, and charges the capacitor to the data voltage during a second sampling period, the data voltage being compensated by as much as a threshold voltage of the driving transistor, the second sampling period being subsequent to the first sampling period.

11. The display device of claim 10, wherein at a point of time when the first sampling period ends, the voltage of the second node is less than a high potential power supply voltage supplied to the first node through the first driving voltage line, and at a point of time when the second sampling period is started, the voltage of the second node is a value obtained by subtracting the threshold voltage from the first voltage or smaller.

12. The display device of claim 1, wherein each of the plurality of subpixels further comprises a fifth transistor electrically connected between the first node and the first driving voltage line, and wherein the fourth transistor and the fifth transistor, in operation, perform a turn-off operation in a period in which the third transistor and the first transistor perform the turn-on operation.

13. The display device of claim 1, further comprising a sixth transistor electrically connected between the light emitting device and an initialization voltage line.

14. A display device comprising:

a display panel having a plurality of gate lines, a plurality of data lines and a plurality of subpixels disposed thereon;

a data driving circuit which, in operation, provides a data signal to the data lines; and a gate driving circuit which, in operation, provides a gate signal to the gate lines, wherein each of the plurality of subpixels includes:

a light emitting device;

a second transistor which comprises a first node electrically connected to a first driving voltage line, a second node that is a gate node, and a third node electrically connected to the light emitting device, wherein the second transistor, in operation, drives the light emitting device;

a first transistor electrically connected between the third node and the data line;

a third transistor electrically connected between the first node and the second node;

a fourth transistor which comprises the third node and a fourth node electrically connected to the light emitting device;

a fifth transistor electrically connected between the first node and the first driving voltage line;

a sixth transistor electrically connected between the light emitting device and an initialization voltage line;

a seventh transistor electrically connected between the third node and a second driving voltage line; and a capacitor electrically connected between the second node and the fourth node, wherein the gate signal includes:

a first scan signal which controls an on/off operation of the third transistor and the sixth transistor;

a second scan signal which controls an on/off operation of the first transistor;

a third scan signal which controls an on/off operation of the seventh transistor;

a first light emission signal which controls an on/off operation of the fourth transistor; and a second light emission signal which controls an on/off operation of the fifth transistor, and wherein a point of time when the third scan signal is switched from a low level to a high level is earlier than a point of time when the second scan signal is switched from a low level to a high level.

15. The display device of claim 14, wherein a point of time when the first scan signal is switched from a high level to a low level is later than a point of time when the third scan signal is switched from a high level to a low level.

16. The display device of claim 14, wherein a point of time when the first scan signal is switched from a low level to a high level is earlier than a point of time when the third scan signal is switched from a low level to a high level.

17. The display device of claim 14, wherein a point of time when the first scan signal is switched from a high level to a low level is earlier than a point of time when the first light emission signal is switched from a low level to a high level.

18. The display device of claim 14, wherein a first voltage which is supplied to the third node through the second driving voltage line is less than a high potential power supply voltage which is supplied to the first node through the first driving voltage line.

19. The display device of claim 18, wherein the first voltage is higher than a data voltage which is supplied to the third node through the first transistor.

20. The display device of claim 19, wherein the first voltage is higher than the data voltage by a constant K, and wherein the constant K is less than a value obtained by subtracting the data voltage of a maximum gradation from the high potential power supply voltage.

21. The display device of claim 19, wherein the seventh transistor, in operation, applies the first voltage to the third node during a first sampling period, and charges the capacitor to the data voltage in a second sampling period, the data voltage being compensated by as much as a threshold voltage of the second transistor, the second sampling period being subsequent to the first sampling period.

22. The display device of claim 21, wherein at a point of time when the first sampling period ends, the voltage of the second node is less than a high potential power supply voltage which is supplied to the first node through the first driving voltage line, and at a point of time when the second sampling period is started, the voltage of the second node is a value obtained by subtracting the threshold voltage from the first voltage or smaller.

* * * * *